US005419587A

United States Patent [19]

McClure et al.

[11] Patent Number: 5,419,587

[45] Date of Patent: May 30, 1995

[54] PERSONALIZED ENVELOPE ASSEMBLY FOR PRINTED PUBLICATION AND METHOD

[75] Inventors: Thomas R. McClure, Malvern, Pa.; Scott A. Stevens, Downers Grove, Ill.

[73] Assignee: Wallace Computer Services, Inc., Hillside, Ill.

[21] Appl. No.: 91,321

[22] Filed: Jul. 14, 1993

[51] Int. Cl.[6] ..... B42D 15/00

[52] U.S. Cl. ..... 283/56; 283/116

[58] Field of Search ..... 281/15.1, 38; 283/56, 283/116; 229/70, 68 R, 301; 462/64, 65

[56] References Cited

U.S. PATENT DOCUMENTS

| | | | |
|---|---|---|---|
| 3,819,173 | 6/1974 | Anderson . | |
| 4,095,695 | 6/1978 | Steidinger . | |
| 4,313,557 | 2/1982 | Foffel | 283/116 |
| 4,567,370 | 3/1986 | Jackson . | |
| 5,114,128 | 5/1992 | Harris, Jr. et al. . | |
| 5,141,252 | 8/1992 | Michlin | 283/116 |

FOREIGN PATENT DOCUMENTS

| | | | |
|---|---|---|---|
| 1463506 | 3/1989 | U.S.S.R. | 412/1 |

*Primary Examiner*—Willmon Fridie

*Attorney, Agent, or Firm*—Tilton, Fallon, Lungmus & Chestnut

[57] ABSTRACT

A signature equipped publication which has bound in to the interior thereof a personalized envelope assembly having at least one insert.

10 Claims, 4 Drawing Sheets

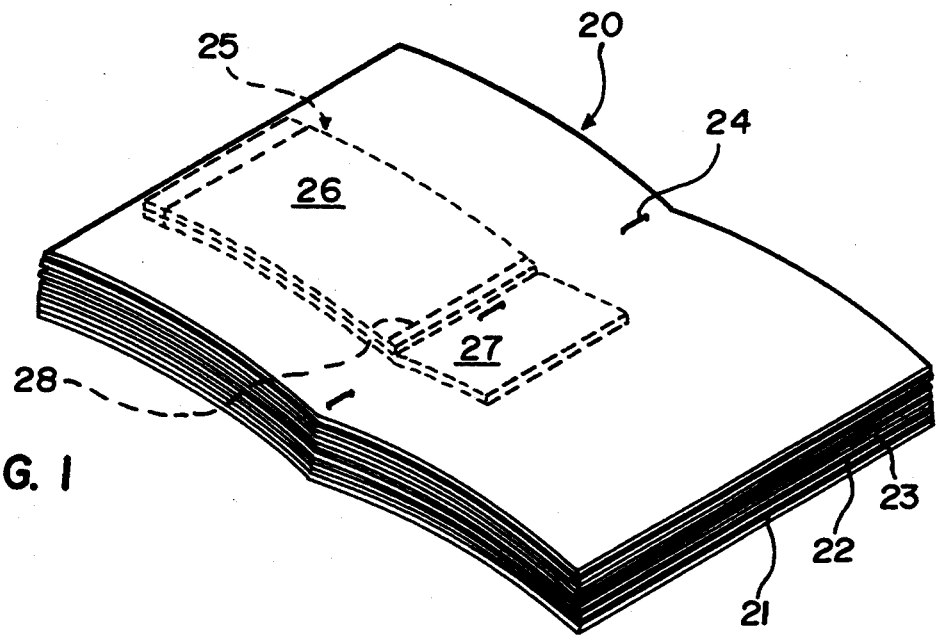
FIG. 1
FIG. 2
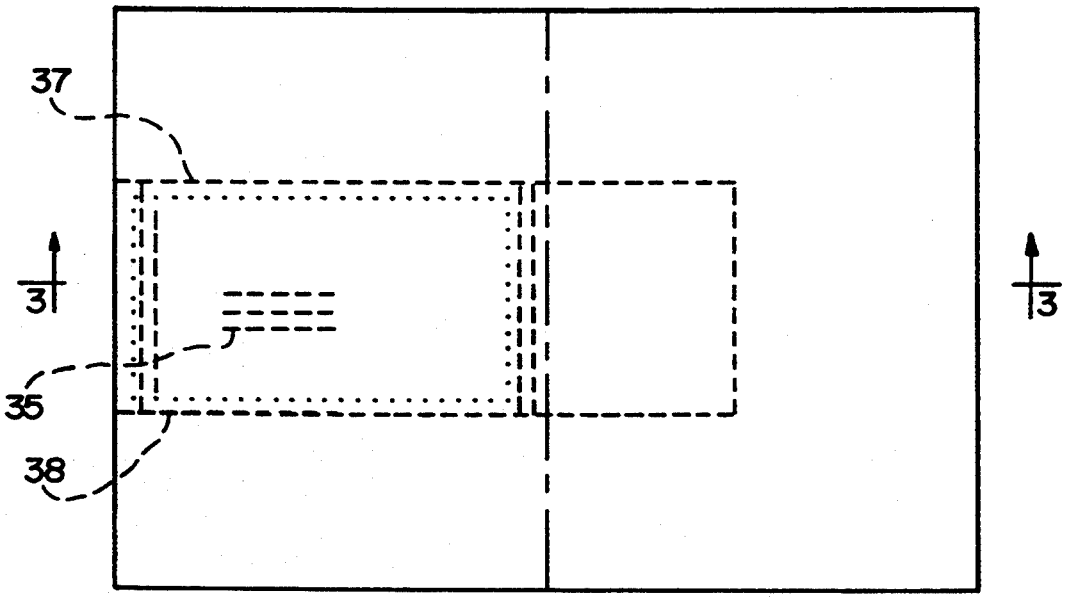
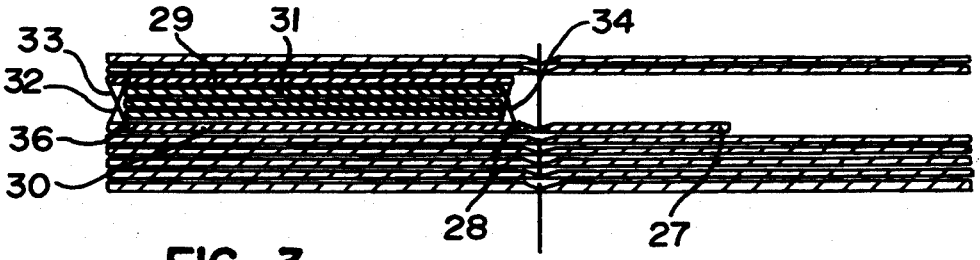
FIG. 3

FIG. 4
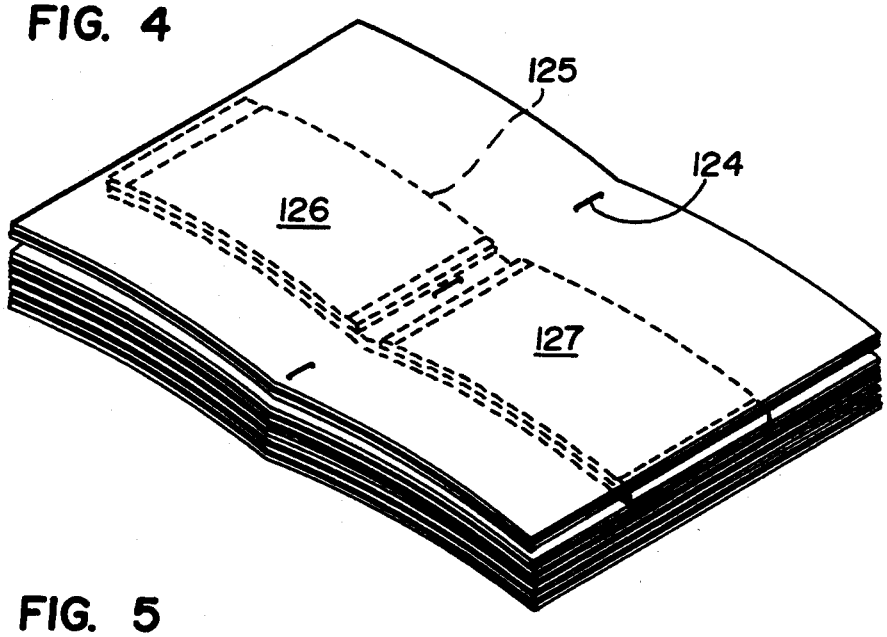
FIG. 5
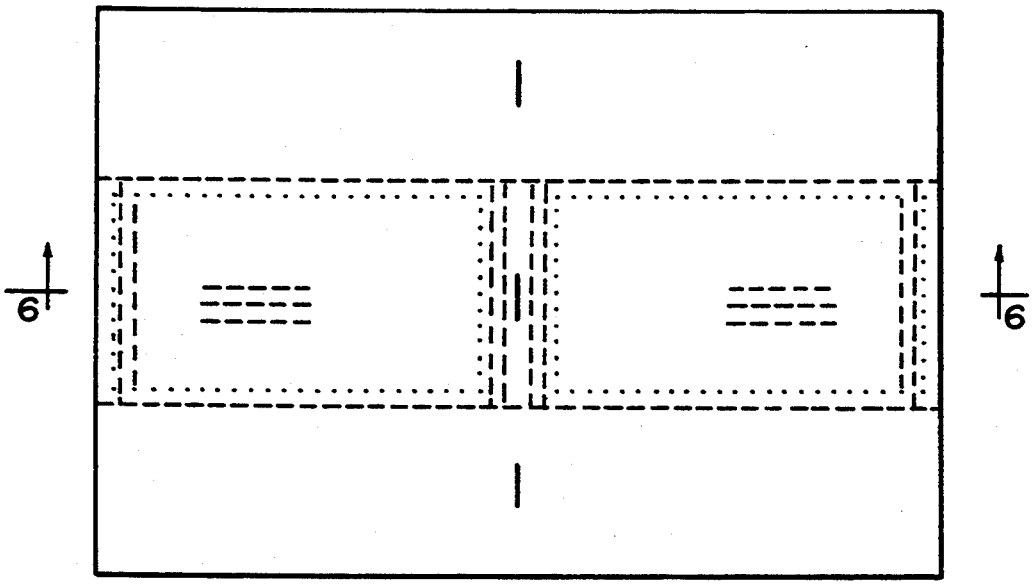
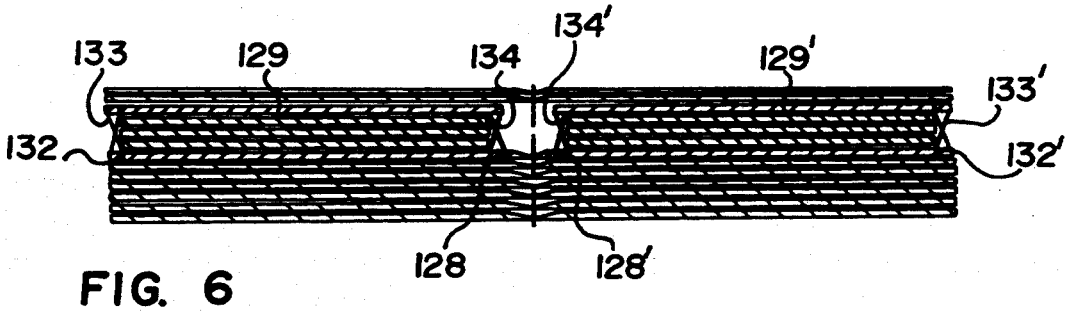
FIG. 6

FIG. 7
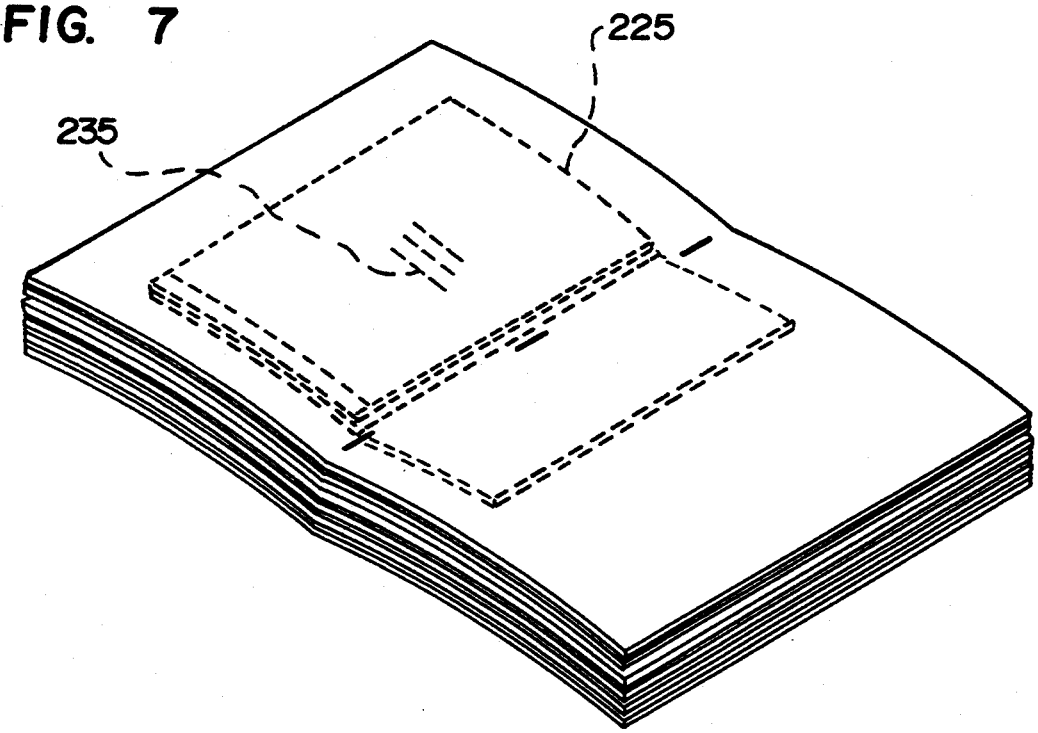
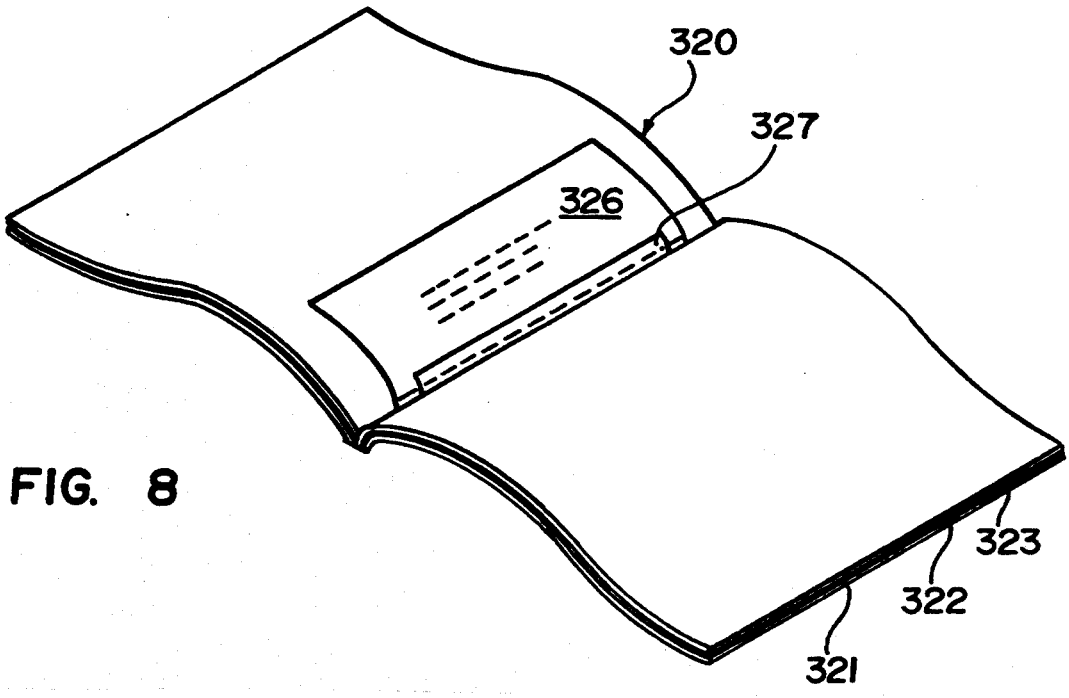
FIG. 8

FIG. 9
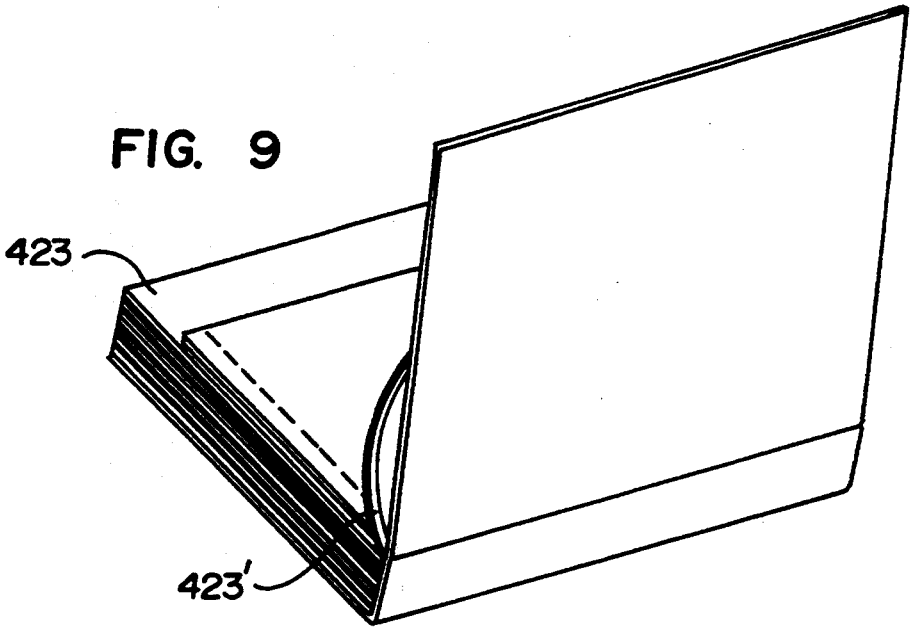
FIG. 10
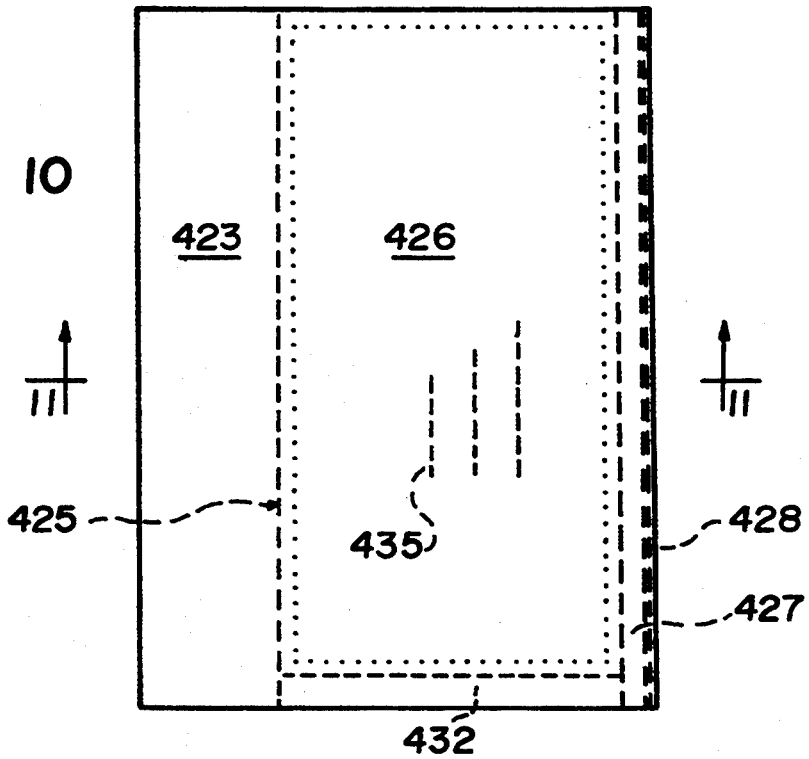
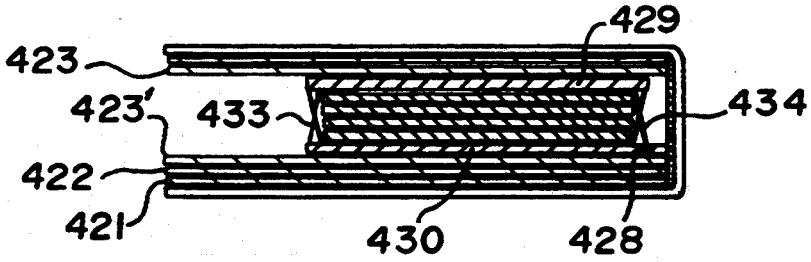
FIG. 11

PERSONALIZED ENVELOPE ASSEMBLY FOR PRINTED PUBLICATION AND METHOD

BACKGROUND AND SUMMARY OF INVENTION

This invention of a product and method relates to a personalized envelope assembly secured to the interior of a printed publication such as a magazine and, more particularly, to the means and method for binding in the envelope assembly to a personalized and/or customized publication.

Over the years, publishers have been interested in both customizing and personalizing signatures of magazines—as seen, for example, in U.S. Pat. Nos. 4,576,370 and 5,114,128. The '370 patent disclosed the idea of tipping an addressed envelope on the magazine's exterior. The '128 patent described a means and method for correlating a personalized signature with the addressee information on the cover sticker. More particularly, the '128 patent was concerned with avoiding the possibility of mix-up—to prevent the personalized signature from going to no person or to the wrong person. Neither patent, however, suggested the idea of binding into the publication an envelope assembly having high level personalization and/or computerized printing on interior and exterior plies that may include directed messages, personal data, statistical information, pictures, maps, graphs, and/or logos, and have this information correlate with the particular recipient of said publication.

More particularly, there was no teaching of providing a publication having a personalized insert-containing envelope bound therein. More specifically, there was no teaching of providing a means on an insert-containing envelope assembly for attaching the same to the interior of a publication. There have been teachings of securing cards to the interior of magazines—as seen, for example, in U.S. Pat. No. 3,819,173. But none of the prior art teachings suggested providing a method and means for binding in a personalized, envelope assembly to the interior of a publication—and this irrespective of whether the signatures component are assembled either by saddle stitching or perfect binding. Normally, those publications over about 48 pages were perfect bound. The instant invention provides means associated with the envelope assembly for attaching in either type of binding.

In one preferred embodiment, this binding means takes the form of an integral extension of one or both of the outer plies of the envelope assembly. This extension may be flap-like in the case of saddle stitching for folding so as to have at least a portion of the extension or flap draped over the saddle conveyor chain. In such a case, the flap to have a dimension perpendicular to the line of perforation for envelope detachment up to about 3½" (90 mm.). Where, however, the envelope assembly is produced for perfect binding, a shorter extension can be used to advantage. In any event, the flap in the perfect binding is of a stiffness approximating that of the signatures—so as to be able to stand on edge. This can be obtained by having flap extensions on both outer plies or making the extension on the extending ply of stiffer material. In either the case of saddle stitching or perfect binding, we equip the binding means or extension with a line of weakness—such as perforation—so as to permit convenient and easy detachment of the envelope assembly.

Other objects and advantages of the invention may be seen in the ensuing specification.

BRIEF DESCRIPTION OF DRAWING

The invention is described in conjunction with the accompanying drawing, in which—

FIG. 1 is a perspective view of a publication illustrating the invention in connection with saddle stitching;

FIG. 2 is a plan view of FIG. 1;

FIG. 3 is a sectional view taken along the sight line 3—3 applied to FIG. 2;

FIGS. 4–6 are views similar to FIGS. 1–3 but of a different embodiment of the invention—where the flap portion incorporates a second envelope assembly;

FIG. 7 is a view similar to FIG. 1 but of another embodiment wherein the envelope length is disposed at 90° to that of FIG. 1; and FIG. 8 is a view similar to FIGS. 1 and 7 but of another embodiment wherein the envelope is adhesively attached to a bound-in portion; and FIGS. 9–11 are views again similar to FIGS. 1–3 but of an embodiment suited for perfect binding.

DETAILED DESCRIPTION

In the illustration given in FIGS. 1–3, the numeral 20 designates generally a publication such as a periodical, magazine, etc. The embodiment of FIGS. 1–3 is of a publication wherein the various signatures 21, 22, 23 are saddle stitched together, i.e., held by staples 24. Also, secured by the staples 24 is an envelope assembly generally designated 25. One form of a suitable assembly for this purpose can be seen in co-owned U.S. Pat. No. 4,095,695 and reference is made hereby thereto wherein a stuffed, sealed envelope assembly is shown and described.

It will be seen that the assembly 25 essentially includes two portions—an envelope portion 26 which can be like that of the '695 patent or other "mailer" and an integral flap portion or binding means 27 which cooperates with the staples 24 in attaching or binding-in the assembly 25 to the interior of the periodical 20. In the illustration given, the portions 26, 27 are defined along a common edge by a line of weakness 28. This may be a line of perforation or other weakening permitting separation of the portions 26, 27 from each other—more especially, the detachment of the envelope for easy handling and access.

As can be seen readily from FIG. 3, the portion 26 includes an outer upper ply 29 and an outer lower ply 30. Sandwiched between the plies 29 and 30 are a plurality of insert plies, one of which is designated 31.

The object of the '695 patent was to provide a "mailer" which used to advantage the computer printing to furnish the addressee information and other variable information on the insert plies such as billing, grades, etc. Thus, the envelope assembly of the '695 patent was intended to go through the mail by itself—and thus had to conform to postal requirements for envelope size, particularly the various dimensions. In particular, there was no suggestion of providing a binding means on portion on the envelope exterior. In contrast, the instant invention departs from conventional "mailer" teaching and provides a means on the envelope exterior for binding the envelope into a publication. More particularly in the illustration given in FIGS. 1–3, the invention provides an integral extension or extensions along an edge of the envelope portion—the portion 27 being provided by an extension of the outer lower ply 30.

Still referring to FIG. 3, the numeral 32 designates a tear strip for providing access to the envelope interior for removing the insert ply (plies). This removes a side portion of the outer upper and outer lower plies 29, 30. These plies are bonded together by lines of adhesive as at 33 and 34—and in some instances the lines of adhesive may extend around the perimeter of the envelope—as in the '695 patent. In other instances, other edges may be left unsealed for ready access as where the interior plies 31, etc. are lightly glued as with frangible adhesive—in which case the tear strip 32 is not needed.

By positioning the envelope assembly as shown in FIGS. 1 and 2 (with the long dimension perpendicular to the binding), the normal printing of the recipient information or other personalized information runs from left to right—see the part designated 35. Thus, when the publication is being read, the information appears in the normal reading disposition. And where the tear strip 32 is provided as shown, the envelope 26 is of the "side-opening" variety. However, in some instances it may be advisable or desirable to provide a "top-opening" envelope, as is more commonly encountered.

It has also been found to be advantageous to position the line of weakness 28 in a position slightly offset from the stitch or fold line, i.e., the line with the staples 24. Thus, when the periodical 20 is opened to reveal the assembly 25, the envelope 26 is conveniently grasped by the thumb and forefingers of the recipient (whose name is imprinted at 35) and torn out of the periodical 20. Thereafter, the envelope portion 26 can be conveniently opened by tearing along the lines of perforation 36 in the outer plies 29, 30 (which define the tear strip 32). This yields access to the interior plies 21–23 which may include a return envelope, coupons or other promotional or advertising material targeted specifically to the named recipient.

In some instances, the personalized, variable information may be placed on both faces of the envelope portion 26. Thus, no matter where the envelope is placed along the various signatures and no matter which way the publications falls open, the recipient will see his/her name. This is particularly the case when the assembly is positioned with its length as shown in FIG. 1 so that the recipient's name is in the normal reading position when he/she opens the publication.

Alternatively, the length of the envelope assembly may extend parallel to the bound edge or spine of the publication. This is illustrated in FIG. 7 where the envelope assembly is designated 225. This type of mounting can be advantageous in providing a longer envelope. Even here it is possible to imprint variable information in the normal reading disposition—for the recipient reading the publication. So, for example, the personalized information may be provided in the normal reading form as at 235. This can be done without any difficulty—particularly since the envelope assembly is not used as a conventional mailer, i.e., going through the mail by itself.

In the production of the assembly 25, the method shown and described in the '695 patent may be generally employed—the ply 30 serving as a carrier web and the ply 29 serving as a confining web for the interior ply or plies. One of the outer plies—the lower ply 30 as illustrated—is extended to provide the flap portion 27 (see FIG. 3). It will be appreciated that the outer upper ply may be the one extended and in some cases the portion 27 providing the binding means may not have to be integral.

When the assembly 25 is to be incorporated into a publication by saddle stitching, it has been found to be advantageous for light weight paper to have the length of the binding portion 27 (that perpendicular to the weakness line 28) or the closely adjacent line of stitching defined by staples 24, be of the order of about 3½" (90 mm.). With heavier material, the flap portion 27 can be shorter—of the order of about 1–2 inches (25–50 mm.). A balance between the ply weight and size insures that the assembly 25 will drop firmly onto the conveying chain when the signatures of the publication are assembled.

Operation Prior to Signature Assembling

Prior to the assembling of each assembly 25 with signatures 21, etc.—and advantageously at the site of manufacture—the assemblies 25 are initially provided in a continuous string of the nature generally seen in the '695 patent modified by the inclusion of a continuous side extension to provide flap portions 27. Then, also at the site of manufacture, the assemblies are stepped through a computer printer to apply the variable or personalized information. Thereafter, the assemblies 25 are burst transversely of the string (as along the lines 37 and 38 in FIG. 2) to provide a stack of individualized envelope assemblies 25 complete with attaching means 27. These may then be cartoned and sent to the publisher for incorporation in the publications 20. This incorporation is usually at a second site—either another plant or in a different area of the forms manufacturing plant. There, electronic scanning can be performed in conjunction with the sequential combining of signatures with an assembly 25 so as to control the relationship of the personalized assembly 25 with the recipient information on the cover of the publication—as is described, for example, in U.S. Pat. No. 5,114,128.

Embodiment of FIGS. 4–6

Referring now to FIGS. 4–6, a modified embodiment is illustrated wherein the flap portion 127 provides or is a second envelope portion. This, with the first envelope portion 126 defines the personalized insert 125. In the construction of FIGS. 4–6, the portion 127 is generally symmetrical to portion 126 about the stitch or fold line, i.e., the line defined by the aligned staples 124. For example, the glue lines 133 and 134 are duplicated at 133' and 134'. The perforation line 128 is duplicated at 128'. Likewise, the tear strip 132 is duplicated at 132'.

It is advantageous in some instances—to prevent "tenting" for example—to remove a chip from the top ply, yielding the top plies 129, 129' as shown.

FIG. 8 Embodiment

As an alternative to the preceding embodiments, the binding-in of the envelope assembly may take the form illustrated in FIG. 8. There the numeral 320 designates generally a publication—of the type previously described at 20. Here, however, the attaching portion 327 is provided separate from the envelope 326. The envelope is adhesively attached to the portion 327 by a band of adhesive which may be provided on the confronting face of the envelope 326 underlying the portion 327. In turn, the attaching portion 327 is secured within the publication 320 by staples or perfect binding depending upon the type of binding. The binding also secures the various signatures 321, 322 and 323 together.

As before, a line of weakness may be employed to permit easy separation of the envelope 326 from the attaching portion 327. In some instances, this line of weakness may be employed to open the envelope 326—as compared to the tear strip 32 provided at the opposite end of the envelope portion 26 in FIG. 3.

Perfect Binding Embodiment

We now refer to the embodiment of FIGS. 9-11 where the binding portion 427 is shorter than the portion 27—of the order of up to about an inch or so (25 mm.) as against up to about 3½" (90 mm.). However, here the binding portion 427 is relatively stiffer in order to stand on end or edge as required in the usual perfect binding. To that end, one of the outer plies 429, 430 is made of heavier material—label stock versus paper. Alternatively, both plies 429, 430 can be extended so as to obtain the requisite stiffness or beam strength for standing on end.

As in the embodiment of FIGS. 1-3, the inventive assembly 425 includes the envelope portion 426 and the securing portion 427. These are again separated or defined in part by a line of weakness 428. The outer plies 429 and 430 of the envelope portion 426 are again adhesively secured together by a pattern of adhesive including segments 433 and 434. Also included is the tear strip 432. Again, as before, the personalized indicia is applied as at 435 to either or both faces of the envelope portion 426. And the cover recipient information is correlated with the information 435 at the site of assembling the signatures 421, 422, 423 and 423' with each inventive assembly 425. This assembly is flanked by the signatures 423 and 423'.

As pointed out above, the concern of previous workers in this art was to safeguard the publication from being incomplete or confused, i.e., the cover addressee information did not agree with the information on the personalized signature. If that is still a concern with the instant invention, the envelope assembly 25, 125, etc. for example, may be equipped with machine readable indicia such as bar code, magnetic encoding, OCR characters or RF. This provides a signal to the control means normally associated with the signature assembly line to develop a cover addressee sticker or the like which agrees with the personalized information 35.

Overall Method of Operation

The stuffed sealed envelope assemblies are provided, i.e., usually manufactured, at a first site—such as the plant of a forms manufacturer. As indicated previously, the assemblies 25, 125, 225, 325, 425 are provided as a continuous string of separable assemblies. At some point of time while the assemblies 25, etc. (either as a unit or as parts), at least one of the outer plies 29, 30, etc. is equipped with personalized recipient information. So also may one or more of the insert plies 31.

Also, at this first site, the assemblies 25 may be equipped with the binding means 27. When this is done at the first site, it is also advantageous to apply a line of weakening 28 to permit ready separation to apply a line of weakening 28 to permit ready separation of parts of the assembly after same has been bound into a publication.

Prior to leaving the first site or at least before being placed in the pockets or hoppers of a binding line, the various assemblies are separated as along transverse lines 37, 38. These are then stacked in the binder line pockets at a second site—where the assemblies are interspersed between signatures incident to publication.

After the publication has been completed, it is mailed and, at a third site, the recipient can detach the stuffed sealed envelope, i.e., the portion 26 etc. It is only necessary that the line of weakness, 28 etc., be located relative to the binding portion 27 etc. so that the recipient can detach the envelope without difficulty. Thereafter, the recipient can remove the insert(s) which may be directed to a specific person, i.e., the recipient, or those in a particular geographic area or in a particular demographic group.

While in the foregoing specification, a detailed description of the invention has been set down for purpose of illustration, many variations may be made in the details without departing from the spirit and scope of the invention.

We claim:

1. A personalized letter product in combination with a mailable publication product, said personalized letter product comprising:

a sealed envelope assembly having a pair of outer plies enclosing at least one insert ply, each of said plies having top, bottom and side edges, at least one of said outer plies being equipped with printed indicia relating to a specific person geographic area or demographic group, and means associated with one of said edges for binding said envelope assembly into the interior of said publication, said publication product comprising a plurality of signatures arranged in superposed relation, each of said signatures being rectangular and having upper, lower and side edges, one of said side edges being a bound edge and the other side edge being a free edge, said envelope assembly edge means including a binding portion bound in between two adjacent signatures along said signature bound edge, and said publication product being equipped with printed indicia corresponding to the envelope assembly printed indicia, said envelope assembly having an edge equipped with means for opening said envelope assembly, said opening means including a line of weakness in at least one of said outer plies.

2. The product of claim 1 in which said binding means includes a flap portion integral with at least one of said outer plies.

3. The product of claim 2 in which said flap portion includes a line of perforation permitting detachment of an envelope portion from said flap portion.

4. The product of claim 3 in which said flap portion has a dimension perpendicular to said line of perforation up to about 3½" (90 mm.).

5. The product of claim 2 in which said flap portion is equipped with a line of weakness defining a detachable stuffed envelope assembly.

6. The product of claim 1 in which said envelope assembly has a plurality of insert plies therein, at least one of said insert plies being equipped with personalized indicia.

7. The product of claim 1 in which said envelope assembly binding portion is saddle stitched in said publication.

8. The product of claim 1 in which said envelope assembly binding portion is perfect bound in said publication.

9. The product of claim 1 in which said binding portion is an integral extension of one of the outer plies of an envelope included in said envelope assembly.

10. The product of claim 1 in which said binding portion has a line of weakness for separating an envelope therefrom.

* * * * *